United States Patent [19]

Kessler

[11] 4,398,360

[45] Aug. 16, 1983

[54] POLE EXCAVATING DEVICE

[76] Inventor: Donald L. Kessler, Pritchard Rd., Springville, N.Y. 14141

[21] Appl. No.: 342,114

[22] Filed: Jan. 25, 1982

[51] Int. Cl.[3] ..... A01G 23/06

[52] U.S. Cl. ..... 37/2 R; 175/220

[58] Field of Search ..... 37/2 R, 81; 175/220

[56] References Cited

U.S. PATENT DOCUMENTS

| | | | |
|---|---|---|---|
| 1,644,560 | 10/1925 | Bignell . | |
| 1,647,840 | 11/1927 | Payne . | |
| 2,775,428 | 12/1956 | Monthan | 37/2 R |
| 3,717,944 | 2/1973 | Clegg | 37/2 R |
| 4,068,396 | 1/1978 | Langguth | 37/2 R |
| 4,326,756 | 4/1982 | Moroz et al. | 175/220 |

FOREIGN PATENT DOCUMENTS

| | | | |
|---|---|---|---|
| 462988 | 6/1972 | Australia | 37/2 R |
| 825845 | 5/1981 | U.S.S.R. | 175/220 |

*Primary Examiner*—E. H. Eickholt

*Attorney, Agent, or Firm*—Christel, Bean & Linihan

[57] ABSTRACT

A device for excavating material from around the periphery of a pole embedded in the ground. A frame is provided with a plurality of pole-engaging rollers adapted for placement against the pole periphery. An endless chain having one portion looped about the pole and another portion looped about sprockets carried by the frame secures the device to the pole. The sprockets are rotatably positioned on the frame at a slight inclination to a true horizontal plane and engage the chain for transporting the frame along the chain and in a descending helical path along the pole. A chain tension sprocket is provided and is movable toward and away from the pole axis to adjust the chain tension. An auger is carried by the frame and is adapted to cut an annular opening in the ground around the pole. Drive means are provided to urge the frame, and thereby the auger, around the pole and in a downward direction.

13 Claims, 8 Drawing Figures

90
94
92
88
84
86
76
4
80
78
75
73
17
82'
72
14
14
74
70
12
118
66
60
46
122
62
100
116
108
124
106
112
110
76
50
52
10
36
30
38
S
32
34
40
42
18
22
26
144
4
18
26
22
20
20
142
136
132
138
130
44
134
P
140
54

POLE EXCAVATING DEVICE

BACKGROUND OF THE INVENTION

This invention relates to an excavating device and more particularly to a pole excavating device for removing material from around the periphery of the base of an upright pole partially embedded in such material, to thereby expose the base of the pole for inspection and treatment.

It is a common expedient to support electric transmission cables, telephone lines, and the like above the ground on spaced, upright poles embedded in the earth. Such poles are generally wood and, particularly in the area about and just below the ground level, are susceptible to oxidation and decay due to moisture, insects, and various other elements deleterious to the wood. Accordingly, the portions of such poles which are below the ground level are periodically inspected and, if necessary, treated with a suitable wood preservative or, if excessively damaged, removed and replaced. In order to expose the embedded portion of the pole for inspection, treatment or removal, the earth thereabout must be removed; this is frequently done manually with a pick and shovel. Due to the size of these hand tools and the manner in which they are manipulated, excessive material is removed with excessive backfill labor involved, which is a time-consuming, laborious, and cumbersome process, and is particularly difficult when large rocks or tree roots are encountered.

SUMMARY OF THE INVENTION

It is, therefore, an object of the present invention to provide an excavating device for removing earth from around a pole which is embedded therein.

It is another object of this invention to provide the foregoing device with means for attachment to a pole and for guiding the path of movement of said device around the pole in a downwardly directed, helical path.

Briefly stated, in accordance with one aspect of the present invention, a device is provided for excavating the ground material from about an upright pole which is embedded in the material. The device includes a frame and an auger mounted on the frame. A plurality of rollers are rotatably mounted in the frame and are engageable with the surface of the pole. The frame carries attaching means to attach the device to a pole, the attaching means being adapted to be looped about a pole in a helical path. Means are provided for revolving the frame about the pole and along the looped portion of the attaching means and include means for gradually displacing the frame in a direction generally parallel to the axis of the pole and in a generally helical path.

The foregoing and other objects, advantages and characterizing features of the present invention will become clearly apparent from the ensuing detailed description of an illustrative embodiment thereof, taken together with the accompanying drawing wherein like reference numerals denote like parts throughout the various views.

DESCRIPTION OF THE PREFERRED EMBODIMENTS

Figure 1:
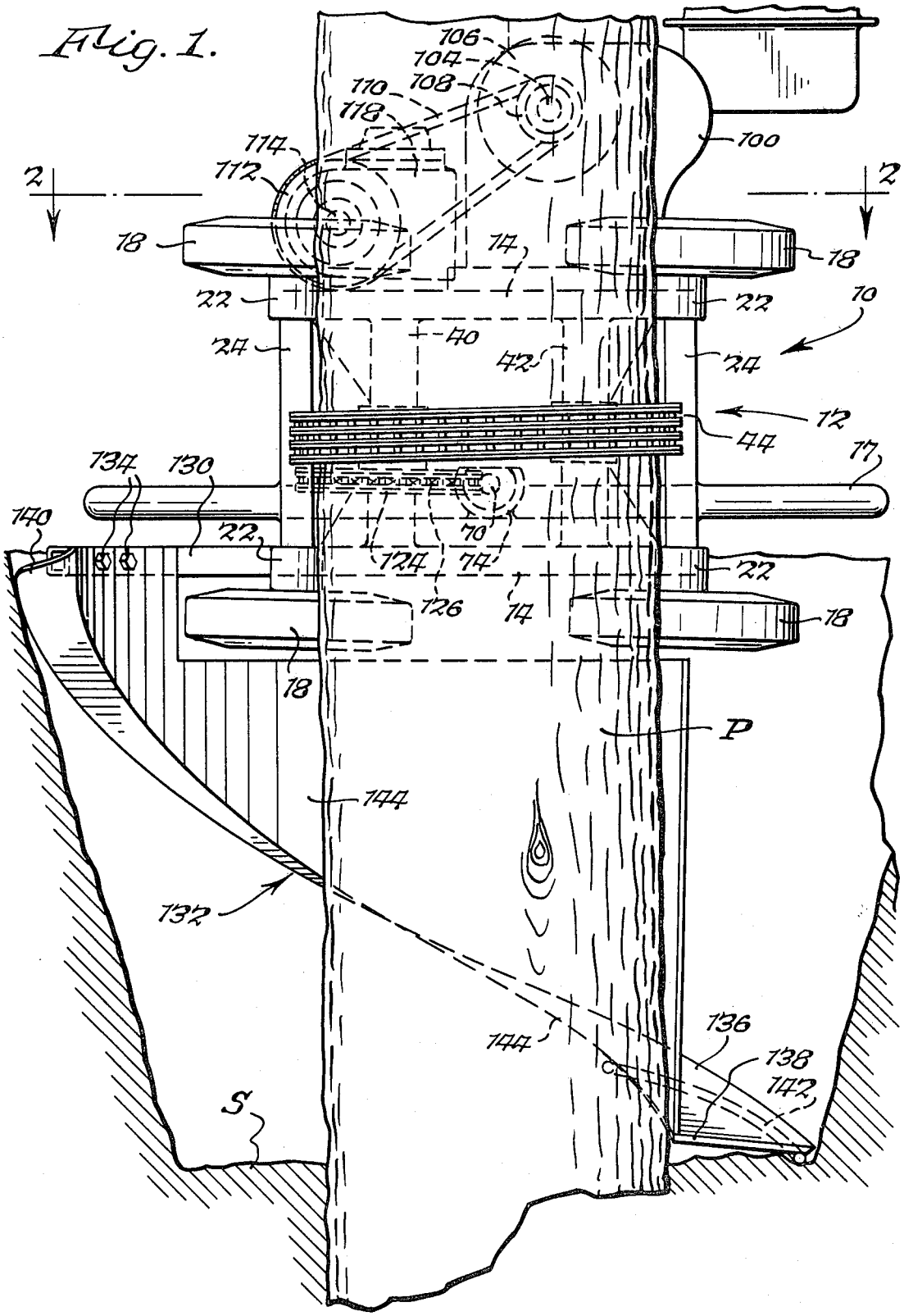
FIG. 1 is a front elevational view partially broken away and partially in section, showing an excavating device in accordance with the present invention positioned on a pole embedded in the ground, and adjacent the ground level.

Referring now in detail to the drawings, there is shown in FIG. 1 an excavating device, generally designated 10, shown positioned on the periphery of an upstanding pole P embedded in the earth S. Device 10 includes a supporting frame 12 formed of a series of rectangular sections 14 of metal tubing welded or otherwise fixedly secured together to form a generally rectangular three-dimensional framework structure including cross-brace members 16 for added rigidity. A generally circular tubular member 17 is welded or otherwise fixedly secured to frame 12 and serves as a carrying handle to facilitate the transport and positioning of device 10.

Figure 3:
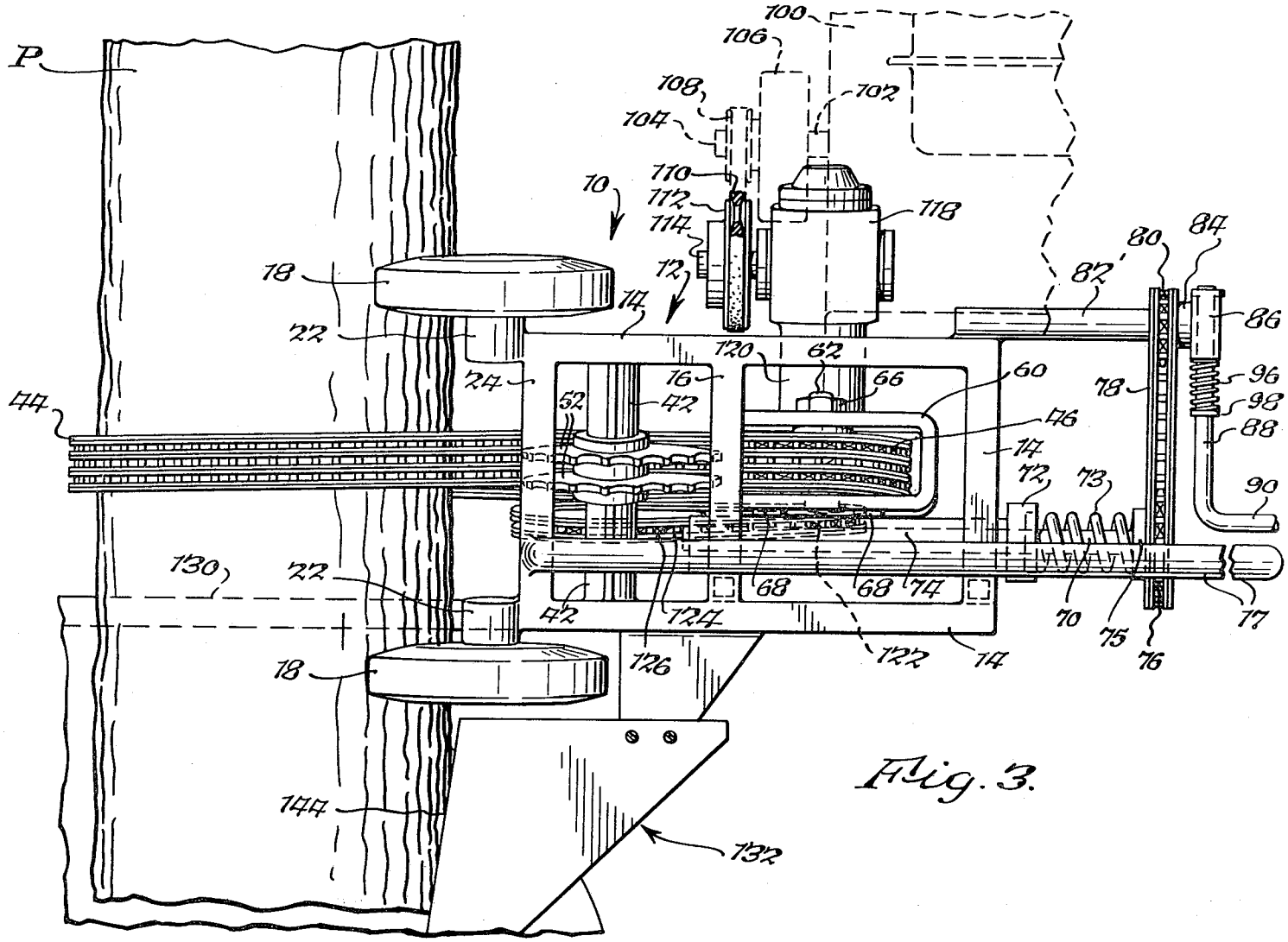
FIG. 3 is a fragmentary side elevational view of the excavating device of FIG. 1.

Frame 12 carries four rollers 18 suitably journalled on shafts 20 mounted in bosses 22 positioned on the outer ends of cross bars 24 (see FIG. 3) which form a part of frame 12. Cotter pins 26 inserted through openings adjacent the outer ends of shafts 20 secure rollers 18 in position. Preferably, the outer surfaces of rollers 18 are of rubber, but can be formed of any other suitable resiliently yieldable material, if desired. Although that portion of device 10 to which rollers 18 are attached is considered the base or lower portion of the apparatus, it should be understood that in the normal operating position, device 10 is oriented as best seen in FIGS. 1 and 3 with the axes of rollers 18 extending in a direction generally, but not exactly, parallel to the axis of pole P.

A pair of U-shaped members (see FIG. 2) are provided on opposite sides of frame 12, each having a bight portion 30 and a pair of divergent legs 32 and 34 secured to opposite cross bars 24. A pair of spaced shafts 36, 38 are suitably journalled in bearings 40, 42, respectively, which are connected at their opposite ends at the junctures of bight portions 30 and legs 32 and 34, respectively, of the U-shaped members.

Figure 2:
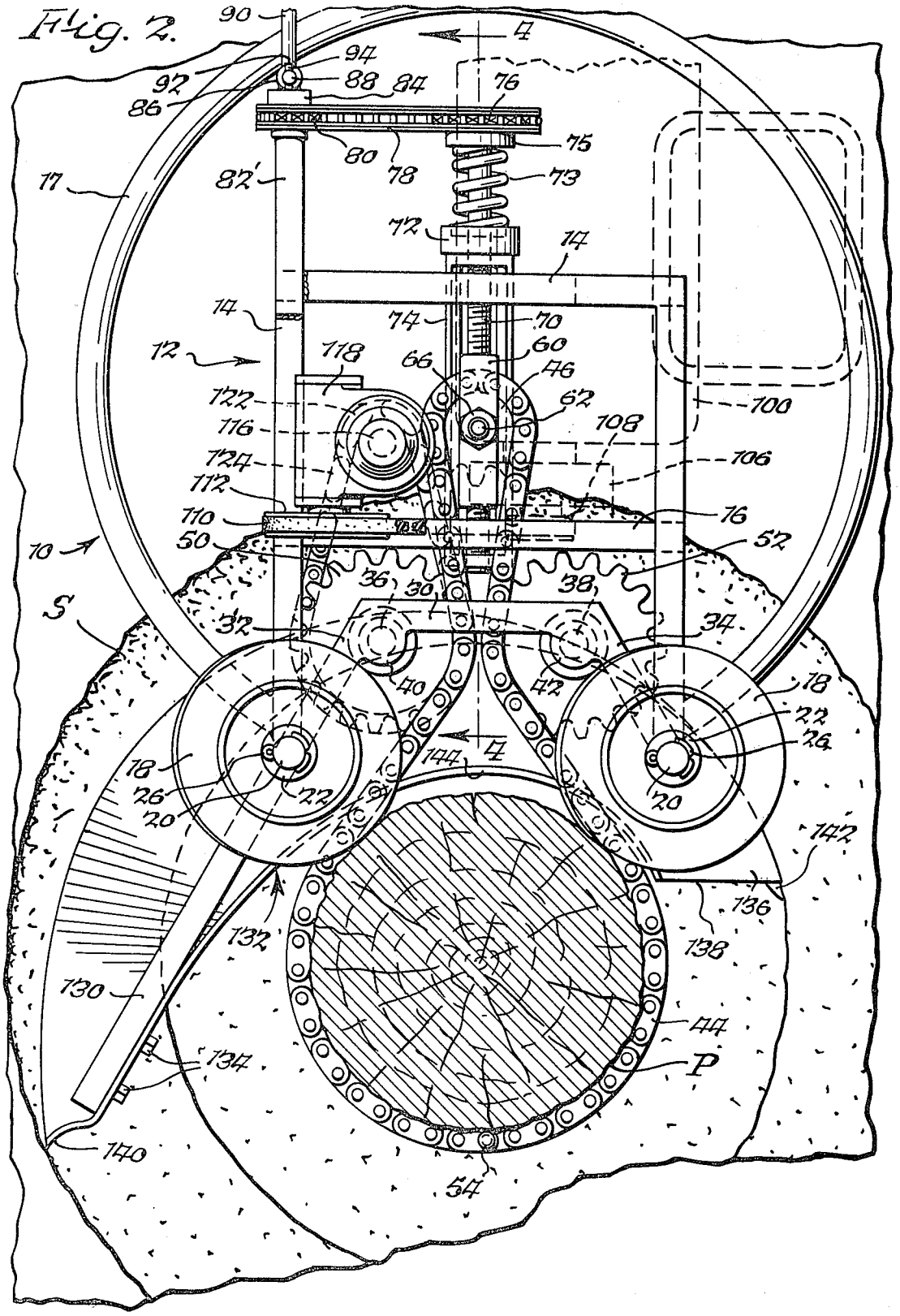
FIG. 2 is a horizontal cross-sectional view taken along the line 2—2 of FIG. 1.
Figure 6:
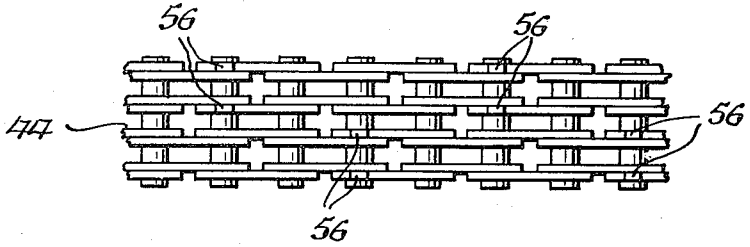
FIG. 6 is a fragmentary bottom plan view of the drive chain of FIG. 5.

Frame 12 is provided with an attaching means, which can be an endless drive chain 44, a portion of which is adapted to be wrapped around the periphery of the pole about which the earth is to be removed. In use, chain 44 passes around a tension sprocket 46 (FIG. 2), an inner portion of a drive sprocket 50 mounted on shaft 36, pole P, and an inner portion of an idler sprocket 52 mounted on shaft 38. When the device is not in use, chain 44 is disengaged at one pair of adjacent links to enable it to be attached to or removed from around the periphery of pole P, and it is connected together about pole P as by means of a removable pin 54 when the device is to be used. As shown in FIGS. 1, 3, and 6, chain 44 can be a double row link chain, i.e., a pair of side-by-side single chains joined together to form a composite, double row chain. Likewise, sprockets 50 and 52 each have a row of laterally spaced teeth extending circumferentially about the peripheries thereof. Of course, a single chain accommodated on a pair of single row sprocket teeth can be used, if desired. Additionally, and depending upon the character of the earth about pole P, V-belts, lug belts, or other suitable forms of attaching means can be provided, if desired. When a chain is provided as a drive means a plurality of outwardly extending gripping projections 56 can be provided on chain 44 to provide gripping engagement of chain 44 against the periphery of pole P. Preferably, sprockets 50 and 52 are spaced relatively near to each other as shown in FIG. 2 to prevent chain 44 from disengaging therefrom when the chain is disconnected, or is not under tension.

An important feature of this invention is the slightly inclined disposition of the axes of sprockets 50 and 52 relative to the axis of pole P to guide or direct chain 44 in a downward direction along pole P as device 10 revolves thereabout. To this end, the axes of shafts 36 and 38, and of their respective bearings 40 and 42, are slightly inclined from true vertical. As viewed in FIG. 1 the axes of bearings 40 and 42 are slightly inclined from their bottoms upwardly toward the right at an acute angle to the true vertical. This causes the faces of sprockets 50 and 52 to be slightly inclined relative to a true horizontal plane as shown in FIG. 3. Both sprockets 50 and 52 are tilted at the same angle and serve to guide chain 44 in a continuous downward helical path as device 10 revolves thereabout in a clockwise direction about pole P as viewed in FIG. 2. Thus, chain 44 is gradually continuously shifted downwardly along pole P by wrapping and unwrapping successive portions of chain 44 about pole P, and during the wrapping thereof device 10 axially displaces the chain relative to pole P in a descending direction. Chain 44 remains rotationally looped to pole P while device 10 revolves about the pole and along the chain in a gradual, descending helical path.

Figure 4:
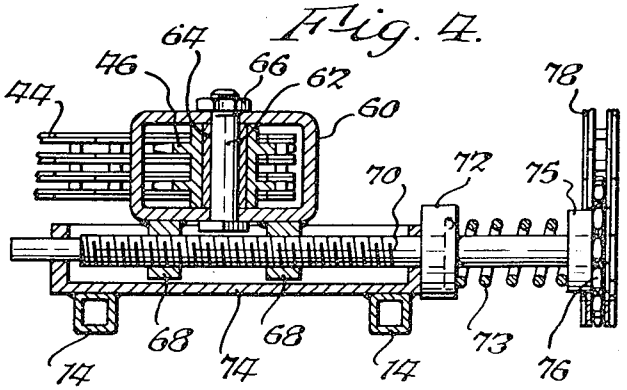
FIG. 4 is a vertical sectional view taken along the line 4—4 of FIG. 2 and showing the chain tensioning means incorporated in the excavating device of this invention.

In order to insure that chain 44 is taut about pole P, a tensioning means such as tension sprocket 46 can be provided. Such tensioning means includes a housing 60 (FIG. 4) for sprocket 46 having a bolt 62 extending therethrough for carrying a sleeve bearing 64 thereon, about which sprocket 46 rotates. A nut 66 is provided to secure bolt 62 relative to housing 60. A pair of axially spaced lugs 68 depend from housing 60 and include threaded bores therein for receiving the threaded portion of an adjusting screw 70 extending through a thrust bearing 72 and carried in spaced, coaxial apertures in a bracket 74 suitably secured to frame 12. Thus, by rotating screw 70, housing 60 and thereby sprocket 46 are moved axially toward and away from pole P to loosen chain 44 about pole P or to take up any slack therebetween, as desired. Housing 60, and thereby sprocket 46, are free to move angularly or tilt about screw 70 to accommodate the angular shifting movements of chain 44 caused by inclined sprockets 50 and 52. A heavy compression coil spring 73 can be positioned about screw 70 between thrust bearing 72 and an abutment shoulder 75 on screw 70 to compensate for irregularities or minor changes in pole diameter and thereby maintain tension in chain 44 without the need for repeatedly resorting to manual adjustment of the tensioning means.

Figure 7:
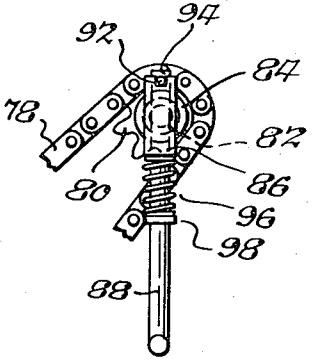
FIG. 7 is a fragmentary side elevational view of the manually operable means for actuating the tensioning means incorporated in the excavating device of this invention.
Figure 5:
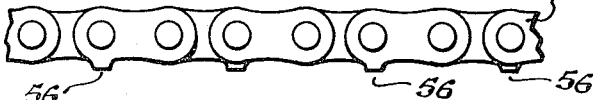
FIG. 5 is a fragmentary side elevational view of the drive chain incorporated in the excavating device of this invention.

The means for rotating screw 70 include a sprocket 76 secured to the distal end of screw 70 for receiving an endless chain 78, which is also trained about a drive sprocket 80 (FIGS. 2 and 3) secured to a shaft 82 journalled for rotation in a bearing support 82, which is suitably fixed to frame 12. Sprocket 80 has a coaxial boss 84 to which a transversely position sleeve 86 is fixedly secured. A lever 88 is slidably positioned in sleeve 86 and is provided with a handle 90 at one end and with transverse pin 92 (FIG. 7) at the other end and which is received in a pair of spaced slots 94 in sleeve 86. A compression coil spring 96 is provided about lever 88 between an abutment shoulder 98 and the end of sleeve 86. In use, handle 90 is manually gripped to rotate lever 88 and thereby sprocket 80 to effect movement of tension sprocket 46 toward or away from pole P by means of chain 78, sprocket 76, screw 70, and housing 60. When not in use, lever 88 can be rotated 90° or more about its own axis to move handle 90 out of the way by merely urging lever 88 axially against the bias of spring 96 to retract pin 92 from slots 94 and by then turning handle 90 in the desired direction.

Figure 8:
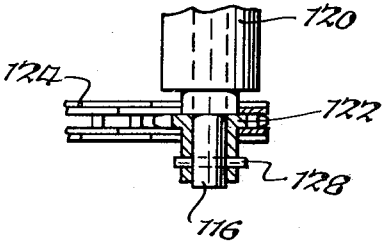
FIG. 8 is a fragmentary side elevational view, partially in section, of the power input shaft and sprocket arrangement incorporated in this invention.

Drive means are provided for driving device 10 about pole P in a slowly descending manner. As shown in phantom in FIG. 3, such means comprises a prime mover, such as a gasoline engine 100, for example, having a rotary drive shaft 102 which is coupled to a shaft 104 by means of a centrifugal clutch 106. Although a four-stroke cycle gasoline engine can be employed, if desired, a two-stroke cycle engine is preferred because of its lighter weight and its ability to operate satisfactorily in any orientation. A drive sprocket 108 is rigidly secured to shaft 104 for receiving a drive belt 110, trained about a sprocket 112, which is rigidly mounted on a shaft 114. Shaft 114 is operatively connected to an output shaft 116 through a gear reduction mechanism 118 (see FIG. 2). Shaft 116 is journalled for rotation in a suitable bearing 120 mounted on frame 12 and is provided with a sprocket 122. An endless drive chain 124 is trained about sprocket 122 and a sprocket 126, which is rigidly mounted on shaft 36 for driving the same. As shown in FIG. 8, a shear pin 128 can be inserted into aligned openings in shaft 116 and sprocket 122 for securing the two elements together in driving relationship. In the event chains 44 or 124 are stalled for any reason, pin 128 will shear, thereby preventing damage to the several components of the drive mechanism.

As shaft 36 is rotated by the drive means, sprocket 50 is driven causing it to ride along endless chain 44, thus carrying the entire device 10 along chain 44 and about pole P. As earlier noted, sprockets 50 and 52 are each oriented at a slight angle of inclination so as to guide chain 44 in a continually downward helical path around the periphery of pole P. Chain 44 slowly descends relative to the axis of pole P, causing device 10 to follow the path dictated by chain 44. Thus, device 10 revolves about pole P in a helical path which gradually descends along the axis of pole P.

As shown in FIGS. 2 and 3, extending axially outwardly from leg 32 of member 28 is an extension 130 forming a continuation of leg 32. An auger, generally designated 132, is securely mounted on extension 130 by means of bolts 134 extending through aligned openings in auger 132 and extension 30. Auger 132 is provided with a spiral channel 136 having a relatively narrow, leading cutting edge 138 at the lower portion thereof and a wider, trailing edge 140 at the top thereof. Channel 136 serves as a chute for carrying the dislodged material upwardly away from the hole being formed and for preventing such material from returning back into the excavation. A curved reinforcing rod 142 is welded or otherwise fixedly secured to the underside of channel 136 adjacent cutting edge 138 to reinforce such cutting edge and to prevent folding or buckling thereof as cutting edge 138 digs into the ground material. The portion of channel 136 adjacent pole P includes an inner side wall 144 of a generally spiral cross section, initially conforming substantially to the peripheral curvature of pole P, but which gradually extends outwardly from pole P as channel 136 ascends upwardly.

As shown in FIG. 1, the auger configuration is shown as to form a downwardly tapering kerf in the ground material around pole P. As device 10 revolves about pole P carrying with it auger 132, cutting edge 138 digs into the earth to fracture and loosen it, which loosened material passes upwardly along channel 136 and is deposited on the surface of the ground outwardly of the hole by means of trailing edge 140 of auger 132. Cutting edge 138 is capable of dislodging and removing small rocks and preferably is sufficiently sharp to cut through roots having thicknesses of up to approximately $\frac{3}{4}$ of an inch. It should be noted that the spacing between the lower inner side 144 of auger 132 and the peripheral surface of pole P is dictated by the position of auger 132 relative to rollers 18 and is independent of the diameter of pole P.

In use, device 10 can be manually carried from pole to pole by means of tubular carrying handle 17, or it can be transported on a cart. When transported, device 10 is on its side whereby the axes of rollers 18 are oriented in a generally vertical direction. Prior to use pin 54 is removed so that chain 44 is opened when presented to a pole P. The free ends of chain 44 are wrapped about pole P and connected together by means of pin 54 while the device is supported against pole P. With the four rollers 18 in engagement with pole P, handle 90 is rotated to move tension sprocket 46 away from pole P until chain 44 firmly embraces pole P and device 10 is supported on pole P by the tension in chain 44. Engine 100 is then started and after shaft 102 is brought to a predetermined speed, centrifugal clutch 106 engages to transmit power to shaft 104. Output shaft 116 will then be rotated by the transfer of power through sprocket 108, drive belt 110, sprocket 112, shaft 114, and the gear reduction mechanism 118. Rotation of shaft 116 causes rotation of shaft 36 by means of a drive chain 124 and sprockets 122 and 126. Sprockets 50, mounted on shaft 36, are in turn driven to effect revolving movement of device 10 along chain 44 and about pole P. Due to the slight inclination of rollers 18, chain 44 slowly descends, carrying with it auger 132 in a helical path downwardly along the periphery of pole P. Cutting edge 138 bites into the ground material, fracturing the same, whereupon it is conveyed upwardly along channel 136 and discharged outwardly at the trailing edge 140 thereof. The machine is revolved about pole P continuously until the desired depth is reached to expose the desired surface area of the embedded portion of pole P. Because edge 144 of auger 132 is spaced slightly outwardly of the periphery of pole P, a thin layer of earth may remain attached to pole P, but it is easily removed to expose the outer surface of the pole. If desired, a protective sheet of rubber or of any other suitable material can be wrapped about the surface of pole P prior to applying chain 44 thereto in order to minimize scarring of the pole surface.

Although auger 132 is preferably configured to excavate a tapered hole having a depth of about eighteen inches, which is substantially deeper than the eight inches of exposure normally required for the proper inspection and treatment of such poles, it should be understood that auger 132 can be made to form bores of deeper or shallower depths, or straight-sided bores, as desired. Indeed, it is contemplated that the entire device 10 can be constructed in a compact arrangement whereby auger 132 can bore a hole of indefinite depth and of a sufficient diameter to enable apparatus 10 to descend into such hole, if desired.

From the foregoing description, it is apparent that the objects of the present invention have been fully accomplished. As a result of this invention a novel excavating device has been provided for removing ground material around a pole embedded therein. By the provision of a chain and inclined sprocket arrangement, the apparatus is positioned on the pole and is driven in a helical path thereabout in a downward direction relative to the pole. This facilitates excavations on very steep slopes since the device is carried by the pole and is not supported by the ground surface around the pole. By the provision of a suitable tensioning means, such as that herein described, the device can accommodate various pole diameters and also can accommodate a pole which has a varying pole diameter. Also, including a spring in the tensioning means permits it to accommodate minor pole surface irregularities. Additionally, the pole-engaging rollers also offer some tolerance for surface irregularities due to their resiliently yieldable characteristics which permit them to compress when engaging a protrusion on the pole surface. By the provision of an auger, a narrow excavation of substantially uniform width can be made to minimize the quantity of material which must be dislodged and removed, thereby reducing the time for subsequent backfill after the inspection and treatment have been completed.

While particular embodiments of the invention have been illustrated and described, it will be apparent to those skilled in the art that various changes and modifications can be made without departing from the spirit and scope of the present invention, and it is intended to cover in the appended claims all such changes and modifications that are within the scope of this invention.

I claim:

1. A device for excavating ground material about an upright pole embedded therein, said device comprising a frame, an auger mounted on said frame, a plurality of rollers rotatably mounted on said frame and engageable with the pole surface, attaching means carried by said frame to attach said device to a pole, said attaching means having a portion thereof adapted to be looped about a pole in a helical path, means for revolving said frame about said pole and along said looped portion of said attaching means, said revolving means including means for gradually displacing said frame in a direction generally parallel to the axis of said pole and in a generally helical path.

2. The device of claim 1 wherein said revolving means includes a pair of sprockets rotatably mounted on said frame and engageable with said attaching means, and drive means for rotating at least one of said sprockets.

3. The device of claim 2 wherein said sprockets are slightly inclined at an angle relative to a true horizontal plane whereby said sprockets continuously displace said attaching means in a direction parallel to the axis of said helical path.

4. The device of claim 2 wherein said drive means includes a source of power, means connecting said power source to an output shaft, chain drive means operatively connecting said output shaft to a drive shaft, said one of said sprockets being mounted on said drive shaft.

5. The device of claim 4 wherein said chain drive means includes a sprocket mounted on said output shaft, and a shear pin connecting said last mentioned sprocket to said output shaft.

6. The device of claim 1 including means for tensioning said looped portion of said attaching means about a pole.

7. The device of claim 6 wherein said tensioning means includes a movable sprocket engageable with said attaching means, and means for moving said movable sprocket toward and away from said looped portion of said attaching means.

8. The device of claim 7 wherein said moving means includes a housing for said movable sprocket, a pair of spaced lugs on said housing having aligned threaded openings for receiving a screw, and means for rotating said screw, said movable sprocket being mounted for angular movement about said screw.

9. The device of claim 7 including means biasing said movable sprocket toward said looped portion of said attaching means.

10. The device of claim 1 wherein said rollers are formed of a resiliently yieldable material compressible upon contact with protrusions on the surface of said pole.

11. The device of claim 1 wherein said attaching means comprises an endless chain.

12. The device of claim 11 wherein said chain is provided with a plurality of inwardly directed gripping lugs to facilitate the gripping of the surface of said pole by said chain.

13. The device of claim 1 wherein said auger is provided with a leading cutting edge, a trailing edge, and a spiral channel ascending from said cutting edge to said trailing edge.

* * * * *